US009196108B2

(12) United States Patent
Kwon et al.

(10) Patent No.: US 9,196,108 B2
(45) Date of Patent: Nov. 24, 2015

(54) APPARATUS AND METHOD OF MAINTAINING AND REPAIRING BANKNOTE VALIDATOR USING A NETWORK

(71) Applicants: Oh Hyun Kwon, Gimpo (KR); Changho Ko, Gunpo (KR)

(72) Inventors: Oh Hyun Kwon, Gimpo (KR); Changho Ko, Gunpo (KR)

(73) Assignee: Kisan Electronics Co., Ltd., Seoul (KR)

( * ) Notice: Subject to any disclaimer, the term of this patent is extended or adjusted under 35 U.S.C. 154(b) by 0 days.

(21) Appl. No.: 14/311,088

(22) Filed: Jun. 20, 2014

(65) Prior Publication Data

US 2014/0379125 A1 Dec. 25, 2014

(30) Foreign Application Priority Data

Jun. 21, 2013 (KR) ..... 10-2013-0071878
Jun. 21, 2013 (KR) ..... 10-2013-0071879

(51) Int. Cl.
*G07F 19/00* (2006.01)
*G07D 11/00* (2006.01)
*G07D 7/00* (2006.01)

(52) U.S. Cl.
CPC ..... *G07D 11/0078* (2013.01); *G07D 7/00* (2013.01); *G07F 19/209* (2013.01)

(58) Field of Classification Search
CPC ..... G07F 19/209; G06F 11/2294
See application file for complete search history.

(56) References Cited

U.S. PATENT DOCUMENTS 5,253,167 A * 10/1993 Yoshida et al. ..... 705/43
5,909,502 A 6/1999 Mazur
6,237,739 B1 5/2001 Mazur et al.
7,699,153 B2 4/2010 Ehrich et al.
8,312,281 B2 11/2012 Silverbrook et al.
8,634,632 B2 1/2014 Numata et al.
8,688,576 B2 4/2014 Hanson et al.
(Continued)

FOREIGN PATENT DOCUMENTS

JP 2004303130 A 10/2004
JP 2011-210104 A 10/2011
KR 10-2010-0107579 A 10/2010

OTHER PUBLICATIONS

Notice of Submission of Opinion from the Korean Intellectual Property Office dated Aug. 13, 2014, for Korean Patent Application No. 10-2013-0071879, with a partial English translation; 6 pages.
(Continued)

*Primary Examiner* — Christle I Marshall
(74) *Attorney, Agent, or Firm* — Andrew D. Fortney; Central California IP Group, P.C.

(57) ABSTRACT

There is provided an apparatus and a method of maintaining, repairing and/or optimizing a banknote validator using a network. The apparatus includes a banknote validator configured to count banknotes or determine genuineness or fitness of the banknotes, a wired or wireless network connection unit configured to relay or transmit one or more first data items and/or software, first data items and software updating, maintaining and/or repairing the banknote valuator and including security information, and a server configured to receive one or more second data items and software version information from the banknote validator and optionally transmit maintenance and repair results to the banknote validator through the wired or wireless network connection unit. The wired or wireless network connection unit may comprise a predetermined smart device or a web adjuster.

22 Claims, 5 Drawing Sheets

(56) References Cited

U.S. PATENT DOCUMENTS

| | | | | |
|---|---|---|---|---|
| 2005/0171661 | A1* | 8/2005 | Abdel-Malek et al. | 701/33 |
| 2011/0060945 | A1* | 3/2011 | Leprince et al. | 714/25 |
| 2011/0246682 | A1 | 10/2011 | Kamimaru et al. | |

OTHER PUBLICATIONS

Abstract of KR20100107579 (A); "Maintenance and Mending System for Counter and Maintenance and Mending Method for Counter"; Sang Hwan Jang; Oct. 6, 2010.

Bibliographic data of JP2011210104 (A)—Oct. 20, 2011; "System and Method for Managing Removable Device, and Program"; worldwide.espacenet.com.

Notice of Submission of Opinion from the Korean Intellectual Property Office dated Jul. 24, 2014, for Korean Patent Application No. 10-2013-0071878, with a partial English translation.

Abstract of JP2004303130; "Authenticity Discrimination Criteria Updating System and New Discrimination Criteria Output Program"; Kobayashi Tsunemasa, Ishikawa Takamitsu and Shibata Tetsunobu; Oct. 28, 2004.

* cited by examiner

APPARATUS AND METHOD OF MAINTAINING AND REPAIRING BANKNOTE VALIDATOR USING A NETWORK

CROSS-REFERENCE TO RELATED APPLICATIONS

The present application claims the benefits of priorities of Korean Patent Application Nos. 10-2013-0071878 and 10-2013-0071879, each filed with the Korean Intellectual Property Office on Jun. 21, 2013. The contents of these applications are incorporated herein by reference in their entireties.

BACKGROUND OF THE INVENTION

1. Field of the Invention

The present invention relates to an apparatus and a method of maintaining and/or repairing a banknote validator using a network, and more particularly, to an apparatus and a method of maintaining and/or repairing a banknote validator, capable of transmitting various information and data items from a banknote validator to a server through a network and transmitting various data items and software to optimize, maintain and/or repair a banknote validator from a server to the banknote validator through a network. The various data items and software may maintain and/or repair the banknote validator or optimize states of various sensors used in operating the banknote validator.

2. Description of the Prior Art

In general, banknote validators are provided in banknote counting machines, vending machines, and automatic teller machines (ATM) to determine whether fed banknotes are forged ones, new ones, old ones, or damaged ones. For reference, the banknote validator described in the present specification covers all banknote counting machines with a banknote validating function and all banknote processing apparatuses with a banknote counting function as well as a banknote validation function. The banknote validators are used in business establishments dealing with checks and cash, such as a bank, a currency exchange office, a post office, a distribution store, a hotel, a department store, a convenience store, a casino, a cash transport firm, and a banknote sorting center, among others.

The banknote validators are sold and installed in various areas or countries all over the world without being limited to any particular area or country, are optimized using banknotes being actually circulated in a host country, and then, are used in the corresponding area or country. In order to optimize the banknote validators, the banknotes must be tested in the field using at least thousands of various banknotes such as newly issued ones, new ones, old ones, wrinkled ones, ones with holes, torn ones, scribbled ones, contaminated ones, bleached ones, and forged ones. However, since a manufacturer may not have sufficient types of the banknotes of the various areas or countries in which the banknote validators are to be used or installed, in an area or a country where the manufacturer is located, the banknote validators are commonly optimized in the host country or area. When a situation in which the banknote validators are used is changed, for example, when a new denomination of banknotes are issued, new forged banknotes are found, a new type of banknotes are found, operating states or set parameters of sensors are changed, or banknotes in new states are found, various sensors in the banknote validators must be periodically or non-periodically (e.g., on request) maintained and repaired in order to optimize the banknote validators so that the banknote validators may adequately operate in the changed situation.

Therefore, in a conventional art, the manufacturer must send many workers (or managers) to the host country for an unreasonably long time to maintain, repair and/or optimize the individual banknote validators, and the manager must connect a laptop computer to the banknote validator by a communication cable on the spot to execute predetermined application programs installed in the computer. Additionally or alternatively, the worker/manager must directly communicate with the banknote validator to obtain various data items from the banknote validator or to store results obtained by counting and validating the banknotes into the computer, to analyze the stored counting and validating results, to transmit such various data items to the manufacturer by e-mail, and to update the various data items. After the updated data items are received by e-mail and are stored in the laptop computer, the updated data items stored in the laptop computer are transmitted to the banknote validator to be updated or optimized. The expressions "various data items" and "updated data items" refer to one or more of forged banknote information, banknote fitness information, banknote images, parameter information, log data, serial numbers, sensing history data, sensor state data, counting data, measurement data of sensors, entire accumulated data, accumulated data since the most recently collected data. In addition, in the conventional art, in order to update the various data items and the software of the banknote validator, the manager stores the software to be updated in the laptop computer or an external-type memory such as a universal serial bus (USB) and a memory card, and then connects the laptop computer and the banknote validator by the communication cable, or connect the external-type memory to the banknote validator, to update or optimize the banknote validator.

As described above, in the conventional art, there have been many problems in that it is unreasonably complicated to update or optimize the various data items and the software of the banknote validator, it takes a long time to perform feedback, much cost and time are spent on storing in a database the collected various data items after visiting the host country, the worker/manager must always carry the laptop computer, the various data items and the software may not be updated or optimized when the laptop computer is not carried, not able to access the most recent data items and software, or an Internet access environment using the laptop computer is not good (for example, when a fixed IP must be set or a Wi-Fi access pass word must be input), or when it is not possible to check whether the stored software is the newest version. In addition, in the conventional art, when the various data items and the software of the banknote validator are stored in the laptop computer, if the laptop computer is lost or hacked, the stored various data items and software may be lost.

Background art to the present invention is disclosed in Korean Patent Registration No. 10-0812254 (registered on Mar. 4, 2008 and entitled "Banknote Validator").

SUMMARY OF THE INVENTION

An aspect of the present invention may provide an apparatus and a method of maintaining, repairing and/or optimizing a banknote validator using a network, capable of transmitting various data items from the banknote validator to a server through a network, and transmitting data items and software for maintaining, repairing and/or optimizing the banknote validator from the server to the banknote validator through the network.

An aspect of the present invention may also provide an apparatus and a method of maintaining, repairing and/or optimizing a banknote validator using a network, capable of remotely optimizing states or environments of various sensors used in operating the banknote validator using a web adjuster over the network.

An aspect of the present invention may also provide an apparatus and a method of maintaining, repairing and/or optimizing a banknote validator using a network, capable of collecting various data items and information generated during the operation of the banknote validator in real time, and transmitting the collected various data items and information to a server to directly store the transmitted various data items and information in a database using a web adjuster (and that may be displayed through a web browser).

An aspect of the present invention may also provide an apparatus and a method of maintaining, repairing and/or optimizing a banknote validator using a network, capable of sharing banknote information of a database (DB) synchronized with a server in real time using a web adjuster so that a manager or user may inquire and analyze the banknote information anytime and anywhere, and maintenance and repair works may be fed back to the manager or user within a short time.

According to an aspect of the present invention, an apparatus of maintaining, repairing and/or optimizing a banknote validator using a network includes a banknote validator configured to count banknotes or determining genuineness or fitness of the banknotes, a wired or wireless network connection unit configured to relay or transmit one or more first data items and/or software configured to update, maintain and/or repair the banknote valuator and including security information, and a server configured to receive second data items and software version information from the banknote validator and transmit maintenance and/or repair results to the banknote validator through the wired or wireless network connection unit. In various embodiments, the wired or wireless network connection unit comprises a predetermined smart device or a web adjuster.

According to another aspect of the present invention, a method of maintaining, repairing and/or optimizing a banknote validator using a network includes connecting a wired or wireless network connection unit and a server, connecting the wired or wireless network connection unit and a banknote validator, requesting various data items from the banknote validator using the server, receiving in the server the various data items, maintaining, repairing and/or optimizing the banknote validator, and after maintaining, repairing and/or optimizing the banknote validator, optionally transmitting maintenance and repair results to the banknote validator. The wired or wireless network connection unit may comprise a predetermined smart device or a web adjuster.

According to another aspect of the present invention, a method of maintaining. repairing and/or optimizing a banknote validator using a network includes connecting a banknote validator to the Internet, automatically connecting the banknote validator to a server, transmitting various data items of the banknote validator to the server (e.g., when the banknote validator starts to count banknotes), classifying the various data items and storing the various data items in a banknote database (DB) using the server, searching or analyzing the various data items in the banknote DB to update optimization information, and maintaining, repairing and/or optimizing the banknote validator using the updated optimization information.

According to the present invention, the various data items of the banknote validator may be transmitted to the server through a designated network, or the various data items and software for maintaining, repairing and/or optimizing the banknote validator are transmitted to the banknote validator through the network so that it is possible to improve convenience, reduce time and cost, and/or transmit the various data items and the software through the (designated) network to improve security.

According to the present invention, the various data items and information generated or detected during the operation of the banknote validator may be collected in real time by the web adjuster, and are transmitted to the server to be directly stored in the DB. The banknote information of the DB may be synchronized with the server and shared in real time using the web adjuster, so that an engineer or other user may inquire and analyze the banknote information anytime and anywhere to rapidly optimize the banknote validator. Therefore, it is possible to easily optimize the banknote validator, to improve banknote validator (or other product) reliability, and/or to reduce time and cost spent on optimizing the banknote validators.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION

Figure 1:
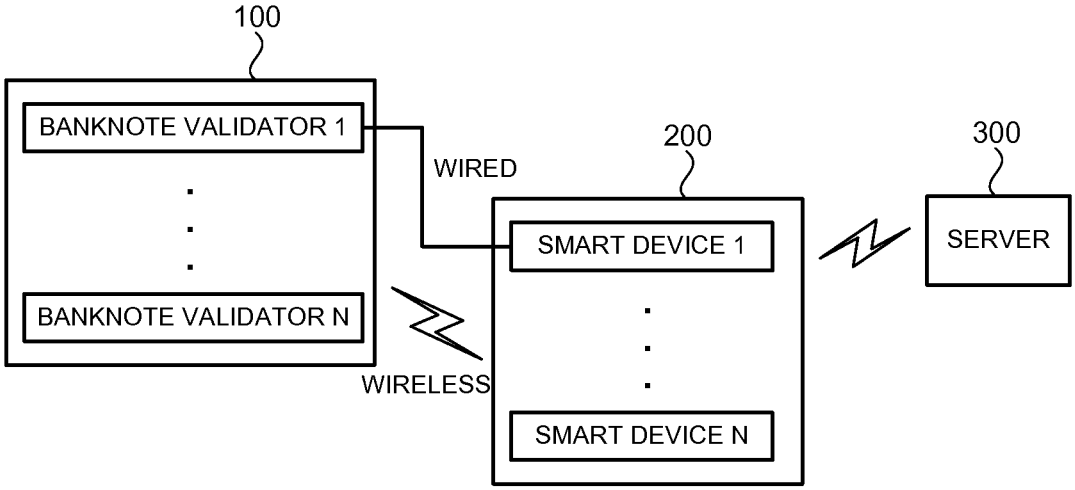
FIG. 1 is a view illustrating a schematic configuration of an exemplary apparatus for maintaining, repairing and/or optimizing a banknote validator using a smart device over a network according to a first exemplary embodiment of the present invention.

Hereinafter, an apparatus and a method for maintaining, repairing and/or optimizing a banknote validator over a network according to the present invention will be described with reference to the accompanying drawings. In the drawings, thicknesses of lines and dimensions of elements may be exaggerated for clarity and convenience. In addition, terms described hereinafter are defined in consideration of functions in exemplary embodiments of the present invention and may be changed according to user/operator's intention or custom. Thus, definitions of terms should be defined on the basis of contents throughout the specification.

According to the present invention, banknote validators may refer to small-, medium-, and large-sized banknote processing apparatuses. The banknote validator may include various sensors such as an image sensor, an infrared ray (IR) sensor, an ultraviolet ray (UV) sensor, a magnetic (MG) sensor, and a tape sensor to determine denominations of banknotes, to identify new banknotes, old banknotes, and damaged banknotes, to count banknotes, and to identify forged banknotes. In addition, the banknote validator may transmit a validation result value to an external apparatus such as a printer, a computer, and a server to process the transmitted validation result value. The banknote validator may include a display unit to display a counting value, for example, the number of the banknotes by each denomination, a counting amount, for example, an amount by denomination or a total amount, and other processing results.

According to the present invention, the network may include a smart device or a web adjuster (to be described later). Therefore, the present invention will be described based on one or more exemplary embodiments in which the smart device is connected over the network, and one or more exemplary embodiments using the web adjuster over the network.

According to the present invention, the "predetermined smart device" and/or "smart device" may refer to an apparatus that may be implemented and/or suitable for various functions and whose most functions may be changed or extended through application programs. For example, the (predetermined) smart device includes a portable computing apparatus such as a smart phone, a tablet PC, a smart pad, and a smart card. In particular, in the case of the smart phone, a data communication function such as Internet access is combined with a conventional mobile phone function. That is, although the user does not access a wired Internet in which a fixed IP must be used, or Wi-Fi in which an access password may be required, the smart device may access the Internet through a mobile communication network and may access a designated national server in another country through data roaming.

Therefore, using such merits of the smart device, in the apparatus and method for maintaining, repairing and/or optimizing a banknote validator using a network, the user may access a server, in which various data items and software for maintaining, repairing and/or optimizing a banknote validator are stored, using a specific smart device, may transmit various data items of the banknote validator to the accessed server, may receive the various data items and the software transmitted by the server and store the various data items and the software in the banknote validator, and thus, may remotely maintain and repair the various data items and the software of the banknote validator anytime and anywhere, and update and optimize the various data items and the software of the banknote validator. In the present specification, the software may be configured to be a program, a set or a plurality of programs, or a combination of the program or set of programs and hardware. The server may be implemented by a web server, a DB server, an application server, a data center, a cloud system, an application store over a network, etc.

When the banknote validator is maintained, repaired or optimized, the various data items and the software thereof may be relayed between the banknote validator and the server using the specific smart device, and not be stored (or deleted although stored [temporarily]) in the smart device so that it is possible to prevent the various data items and the software from being lost if the smart device is lost, and to improve stability and security.

FIG. 1 is a view illustrating a schematic configuration of an exemplary apparatus for maintaining, repairing and/or optimizing a banknote validator using a smart device over a network according to one or more first exemplary embodiments of the present invention.

Referring to FIG. 1, one or more smart devices (e.g., a smart device 1 to a smart device N) 200 may wirelessly communicate with a server 300 using a mobile communication network, for example, a 3G or 4G wireless local area network (LAN) or using Wi-Fi in the Internet environment. At least two of the smart devices (1~N) 200 may simultaneously communicate with the server 300. That is, banknote validators (a banknote validator 1 to a banknote validator N) 100 may be simultaneously or sequentially maintained, repaired and/or optimized using one or a plurality of designated (or authorized) smart devices of banknote validator users (or managers) in a plurality of remote areas or countries.

For example, the server 300 requests various data items, for example, forged banknote information, banknote fitness information, banknote images, parameter information, banknote weight and/or density data, soil (e.g., dirt) levels, log data, serial numbers, sensing history data, sensor state data, counting data, sensor measurement data, entirely accumulated data, accumulated data after recently collected data, and software information to the banknote validator 100 and the manager receives the various data items from the server 300 through the network to optimize the banknote validator 100. Here, optimizing the banknote validator 100 may comprise, for example, optimizing threshold values of sensors, that is, parameters for counting banknotes, identifying forged banknotes, and/or determining fitness of banknotes. The new optimized threshold values (that is, setting values) are transmitted to the banknote validator 100 to maintain and/or repair the banknote validator 100, and/or to optimize the banknote validator 100.

In addition, the smart device 200 (through a wired or wireless connection) connects at least one of the banknote validators 100 in the same area within a predetermined distance to simultaneously or sequentially maintain and/or repair the banknote validators 100 and/or to optimize the banknote validators 100. Since unique identifiers (IDs) or authorization information such as media access control (MAC) addresses are set for the banknote validators 100, respectively, although the banknote validators 100 communicate through the smart device(s) 200 with the server 300, the server 300 may select at least one of the banknote validators (the banknote validator 1 to the banknote validator N) 100 in the same area within the predetermined distance for maintenance and/or repair, and/or to optimize the banknote validators 100. In addition, the smart device(s) 200 may be independently (that is, without connection to the server 300) connected to at least one of the banknote validators 100, respectively, to receive the various data items and the software information generated during operations of the banknote validators 100 in real time, to monitor operation states of the banknote validators 100 and states of sensors, or to adjust and/or optimize the banknote validators 100.

Figure 2:
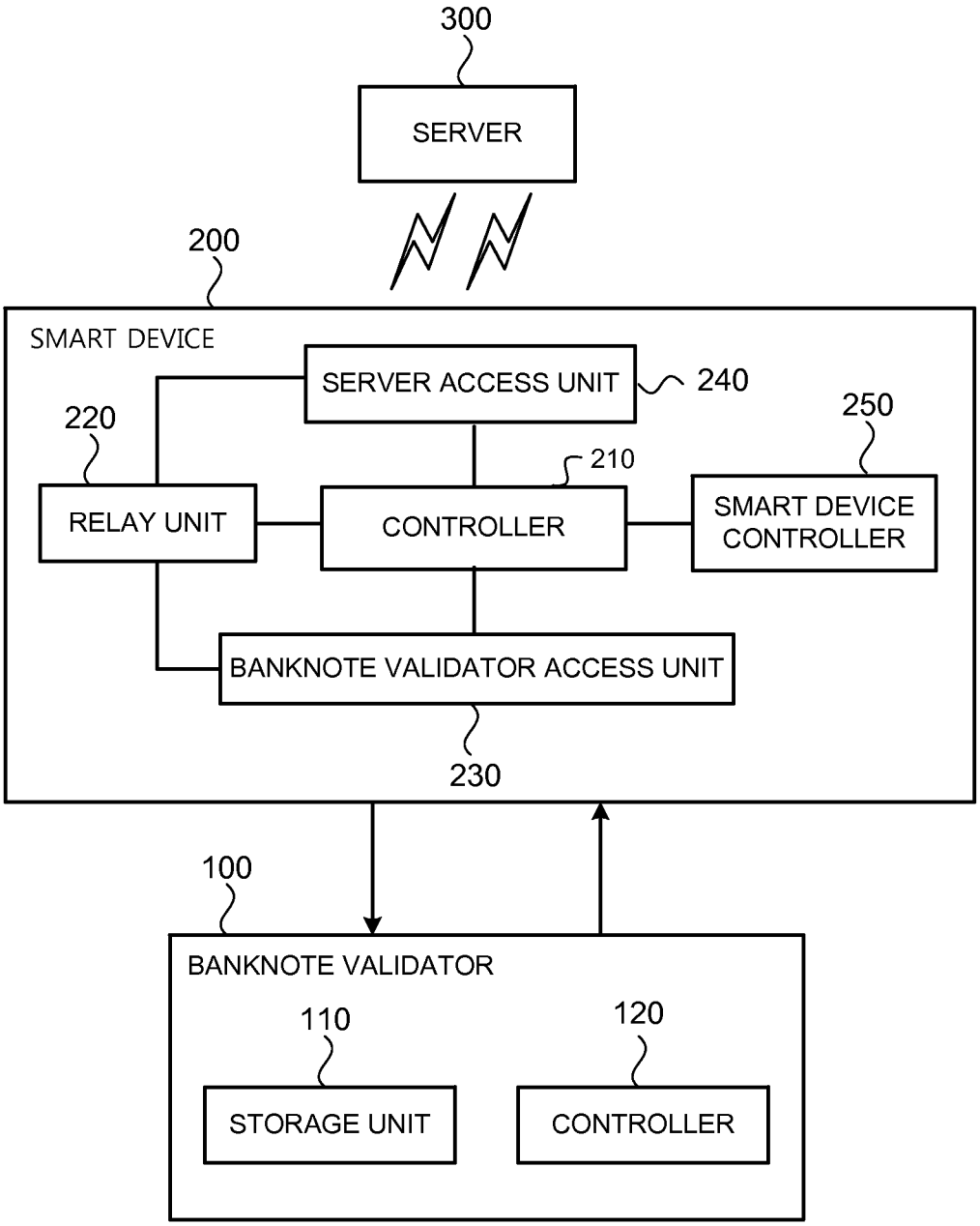
FIG. 2 is a view illustrating a detailed configuration of an exemplary apparatus for maintaining, repairing and/or optimizing a banknote validator using a smart device over a network according to a first exemplary embodiment of the present invention.

FIG. 2 is a view illustrating a detailed configuration of an exemplary apparatus for maintaining, repairing and/or optimizing a banknote validator using a smart device over a network according to one or more first exemplary embodiments of the present invention. The apparatus for maintaining, repairing and/or optimizing banknote validators includes a banknote validator 100 whose various data items and software are to be updated, a smart device 200 for adding various data items to maintain, repair and/or optimize the banknote validator 100 and information on software and security and transmit the various data items and the information on software and security through a network (or a smart device 200 in which an application for maintaining, repairing and/or optimizing the various data items and the software according to the present invention is mounted or installed), and a server 300 configured to store the various data items and the software for maintaining, repairing and/or optimizing the banknote validator 100 and its security.

The banknote validator 100 includes a storage unit 110 configured to store various data items and software, and a controller 120 configured to execute or retrieve the stored various data items and/or software to control banknote fitness determination, forged banknote determination, and banknote counting, among other items. In addition, the banknote validator 100 includes a communication unit (not shown) that may perform data communications with an external device through the network. If the banknote validator 100 further performs other functions, the storage unit 110 and the controller 120 store and operate various data items and software used in performing the corresponding functions. For example, the storage unit 110 stores operation software configured to operate the banknote validator 100 and update software configured to update the operation software and the various data items. That is, when new data or software of a new version is input to the banknote validator 100, the input data or software is automatically updated by the update software. In addition, communication software is stored in the storage unit 110 to transmit or receive the various data items and software through a predetermined communication path.

The smart device 200 (or the smart device 200 in which the application configured to maintain, repair and/or optimize the various data items and the software according to the present invention is mounted or installed) transmits (or relays) the various data items and software version information of the banknote validator 100 to the server 300 through the network, receives the various data items and software that are transmitted from the server 300 to the banknote validator 100 to be maintained, repaired and/or optimized, and/or transmits the received various data items and software to the banknote validator 100. In addition, the smart device 200 may be connected to the banknote validator 100 to receive the various data items and state information of the banknote validator 100, which are generated during the operation of the banknote validator 100, so that the manager or other user may monitor a state of the banknote validator 100 and may adjust or optimize the banknote validator 100 on the spot.

One or more central processing units (CPUs) (not shown) are provided in the banknote validator 100 according to the present invention. The server 300 may check whether a version of software in the respective CPU(s) is a newest one (that is, it compares the version of the software with the newest one) to determine whether it is necessary to update the software. When it is determined that it is necessary to update the software, the software may be automatically or manually updated by the server 300 or an engineer (or the manager or other user).

In addition, the smart device 200 may receive a command transmitted by the server 300 and may analyze and execute the received command as well as the above-described transmitting of the various data items and the software from the banknote validator 100 to the server 300. For example, the command includes a command to designate and transmit security information and a command to control a function of the smart device (for example, a camera, a keypad, a microphone, a speaker, a subscriber identity module (SIM) card, or a global positioning system (GPS)) in order to receive the security information by an input (e.g., from the user). That is, the command may include a command to photograph the face of the user and to transmit the photographed face of the user during transmission of the various data items and the software, a command to receive as an input the voice of the user and to transmit the received voice of the user during transmission of the various data items and the software, and/or a command to receive user authorization information by an input such as a resident registration number, an employee identification number, a password, local current time, current position information, and/or a telephone number of the smart device, and to transmit the input user authorization information during transmission of the various data items and the software. The command may include a control command to additionally receive various security information items by an input (e.g., from the user) to transmit the received various security information items.

Here, the user authorization information includes information that must be directly input by the user and information that may be automatically detected to be input such as internal information of the smart device (for example, SIM card information and MAC address information). The command to control an input of the security information randomly requests request time of the security information or a kind of the security information so that a person who is not the user may not easily respond effectively to the command. That is, although the designated smart device may be lost, when the person who acquired the smart device does not know the user authorization information, he or she may not use the smart device.

The smart device 200 generally includes a controller 210, a relay unit 220, a banknote validator access unit 230, a server access unit 240, and a smart device controller 250.

The controller 210 analyzes the command received from the server 300 over the network to execute a function corresponding to the command. When the banknote validator 100 is connected to (accesses) the banknote validator access unit 230 with hardware, the controller 210 automatically controls the server access unit 240 to communicate with the server 300 through a predetermined path, for example, an Internet address. That is, the controller 210 sets the communication path. When the user executes a specific application (e.g., the application for maintaining, repairing and/or optimizing the various data items and the software according to the present invention) previously provided in the smart device, the controller 210 controls the server access unit 240 and communicates with the server 300. The banknote validator access unit 230 and the banknote validator 100 including a communication unit (not shown) may be connected by a wired or wireless method, for example, Bluetooth, near field communication (NFC), infrared rays (IR), Wi-Fi, a LAN, a long term evolution (LTE), etc.

The controller 210 receives the command transmitted by the server 300 to analyze the received command. The controller 210 controls the banknote validator access unit 230 in accordance with the command to communicate with the banknote validator 100 connected to the banknote validator access unit 230 with hardware. As the communication path is set as described above, the server 300 may access the storage unit 110 of the banknote validator 100 to fetch or retrieve desired various data items and/or software version information. When a command to fetch or retrieve the various data items and the software version information is received from the server 300, the controller 210 transmits the various data items and/or the software version information from the banknote validator 100 to the server 300 through the relay unit 220.

In addition, when a command to store various data items and software to be maintained, repaired or optimized in the banknote validator 100 is received from the server 300, the controller 210 transmits the various data items and the software to be optimized from the server 300 to the banknote validator 100 through the relay unit 220. The controller 120 of the banknote validator 100 stores the received various data items and/or software in the storage unit 110 using the communication software and/or the update(d) software, and maintains, repairs and/or optimizes the stored various data items and software. When a command to monitor a current operation state of the banknote validator 100 is received from the server 300, the various data items generated during the operation of the banknote validator 100 may be monitored by a display unit (not shown) of the smart device 200, and previously processed results or previously generated and stored various data items may be inquired and analyzed.

As described above, in a process of transmitting the various data items and the software configured to maintain, repair and/or optimize the banknote validator 100 and the software version information, the controller 210 may transmit (or relay) the various data items and the software without storing the various data items and the software. If the various data items and the software are stored, the various data items and the software may be deleted by a delete command input. The controller 210 may perform control operations and/or commands so that communication and/or connection to the banknote validator 100 is performed by the server 300. Therefore, if the smart device is lost, the stored various data items and software may not be lost or accessible by an unauthorized user.

The relay unit 220 delays transmission of the various data items, the software, and the software version information between the server 300 and the banknote validator 100. When the security information is additionally transmitted to the server 300, the security information may be included in the various data items, the software, or the software version information (e.g., in a data packet, suitable for or in a predetermined form or format). The smart device controller 250 controls the function of the smart device 200, for example, the camera, the keypad, the microphone, the speaker, the SIM card, or the GPS in accordance with the command received from the server 300. The smart device controller 250 is controlled by the controller 210 to control the corresponding function of the smart device 200. The controller 210 may transmit the security information detected or input by the smart device controller 250 to the server 300, or may transmit the security information together with the various data items, the software, and the software version information. The security information does not necessarily have to be transmitted, and only the various data items, the software, and the software version information may be transmitted.

Figure 3:
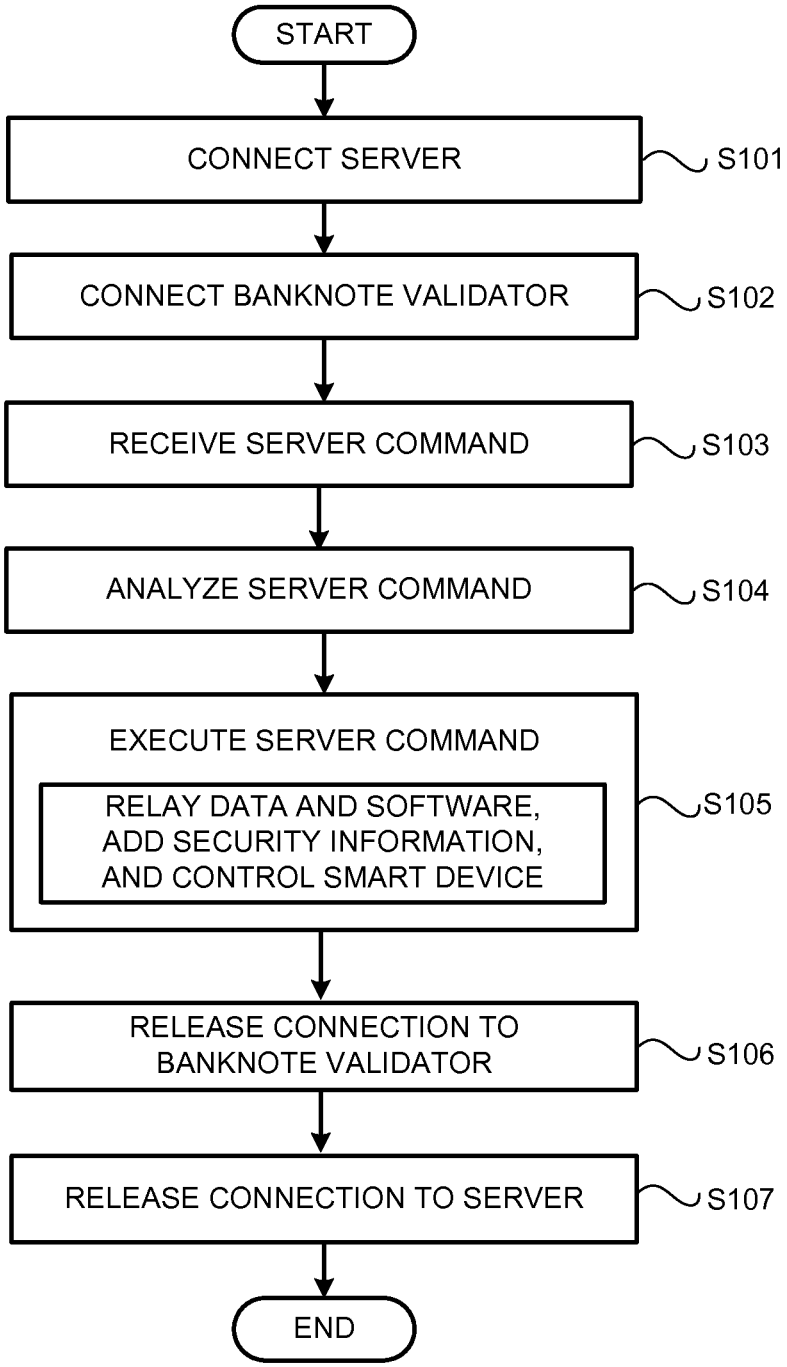
FIG. 3 is a flowchart illustrating an exemplary method of maintaining, repairing and/or optimizing a banknote validator using a smart device over a network according to a first exemplary embodiment of the present invention.

FIG. 3 is a flowchart illustrating an exemplary method of maintaining and/or repairing a banknote validator using a smart device over a network according to a first exemplary embodiment of the present invention.

As illustrated in FIG. 3, the controller 210 of the smart device 200 detects a server access command (for example, a command through application execution of the banknote validator user (or manager) or hardware connection (or access) between the banknote validator access unit 230 and the banknote validator 100) and, when the server access command or the hardware connection between the banknote validator access unit 230 and the banknote validator 100 is detected, controls the server access unit 240 and communicates with the server 300 through the network S101. The order of connection between the banknote validator 100 and the server 300 may be reversed.

When the server 300 and the smart device 200 are connected, in accordance with the command of the server 300, the controller 210 connects the banknote validator 100 and the smart device 200 through the banknote validator access unit 230 S102. As described above, when the server 300 and the banknote validator 100 are connected through the smart device 200, the controller 210 receives a command from the server 300 S103 and analyzes the received command S104.

The command transmitted by the server 300 in relation to maintaining, repairing and/or optimizing the banknote validator 100 may include at least one of, for example, a command to transmit the various data items and the software version information of the banknote validator 100 to the server 300, a command to display current or past various data items and software information from the banknote validator 100 and/or state information of various sensors, a command to transmit the various data items and the software from the server 300 to the banknote validator 100, a command to additionally transmit the security information, and/or a command to control the function of the smart device 200 in order to receive the security information.

On the other hand, as an example of updating of the software, the user presses a software detection button (not shown) of or in an application to automatically detect the software version of the banknote validator 100 and to compare the software version of the banknote validator 100 with the newest software version of the server 300. When it is determined that the software version of the banknote validator 100 is not the same as the newest software version of the server 300, whether to repair, update or optimize the software in the banknote validator 100 is displayed so that the user may make a selection. Then, the software may be updated, optimized or repaired in accordance with the selection of the user. The various data items and the software are preferably not stored in the smart device 200. However, if the various data items and the software are stored in the smart device 200, the server 300 may additionally transmit a delete command to delete the various data items and the software from the smart device 200.

In addition, the controller 210 analyzes the command transmitted by the server 300 and executes a command corresponding thereto S105. After the server 300 transmits the various data items and the software to the banknote validator 100, the controller 210 releases the connection (or access) to the banknote validator 100 S106 and releases the connection (or access) to the server 300 S107.

The connection (or access) may be released by the command transmitted by the server 300 or by a command (a command to stop application execution) input by the user. In addition, when the hardware connection (or access) between the banknote validator access unit 230 and the banknote validator 100 is released, the connection (or access) may be automatically released. The order of releasing the connection between the banknote validator 100 and the server 300 may be reversed.

A method of automatically maintaining, repairing and/or optimizing the banknote validator 100 has been described. However, the engineer (or the manager or other user) may manually access the banknote validator 100 through the smart device 200 to grasp, determine or observe the state of the banknote validator 100 or to receive the various data items.

Figure 4:
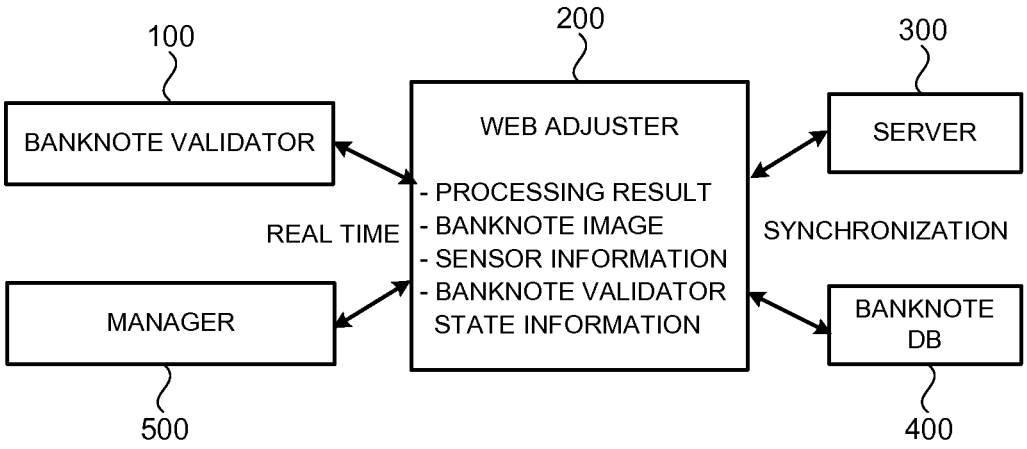
FIG. 4 is a view illustrating a schematic configuration of an exemplary apparatus for maintaining, repairing and/or optimizing a banknote validator using a web adjuster over a network according to a second exemplary embodiment of the present invention.

FIG. 4 is a view illustrating a schematic configuration of an exemplary apparatus for maintaining, repairing and/or optimizing a banknote validator using a web adjuster over a network according to one or more second exemplary embodiments of the present invention.

According to the second exemplary embodiment(s) of the present invention, when banknotes are counted, counting and validating results are stored in a server using a web adjuster. Although a manager (or an engineer or other user) who performs professional work is not near the banknote validator, the various data items stored in the server may be analyzed and automatically or manually fed back. Therefore, the number of managers or users may be minimized, and feedback time may be reduced so that the banknote validator may be rapidly maintained, repaired or optimized.

As illustrated in FIG. 4, the apparatus of maintaining, repairing and/or optimizing a banknote validator using a web adjuster over a network according to the second exemplary embodiment(s) of the present invention includes one or a plurality of banknote validators 100 configured to validate banknotes, a web adjuster 200 connected to the banknote validator 100 and a server 300 through the Internet (configured to display or transmit information relating to maintenance and/or repair of the banknote validator 100), and the server 300 configured to collect various information and data items from the banknote validator 100 through the web adjuster 200. The apparatus may further include a banknote database (DB) 400 configured to store the various information and data items collected from the banknote validator 100.

Since the banknote validator 100 is the same as that of the first exemplary embodiment(s), a description thereof will not be given.

The banknote validator 100 may directly access the Internet by a wireless communication method (for example, Bluetooth, Wi-Fi, NFC, or infrared rays) or a wired communication method (for example, a LAN, a universal serial bus (USB), IEEE1394, or a serial or parallel connection), or may access a designated computer (or adjustment programs provided in any computing apparatus).

At least one Internet address, through which the banknote validator 100 may access the server 300, may be registered in the banknote validator 100. When the banknote validator 100 cannot access the server 300 through a first Internet address, the banknote validator 100 may access the server 300 sequentially through a next Internet address.

The banknote validator 100 may automatically access the server 300 through the network using unique authorization information such as an ID and an MAC address of the banknote validator 100. The server 300 may automatically detect a country or an area (or a position) in which the banknote validator 100 is installed, using the authorization information. That is, optimization information of the banknote validator 100 that accesses the server 300 may be automatically fetched or retrieved from the banknote DB 400 in accordance with the type of banknotes corresponding to the country or the area in which the banknote validator 100 is installed. In addition, the optimization information corresponding to the banknote validator 100 may be updated.

When banknotes are counted after the banknote validator 100 accesses the server 300 through the network, the banknote counting and validating results are automatically transmitted to the server 300. Anyone (e.g., the manager or other user on the spot) near the banknote validator 100 can feed the banknotes to the banknote validator 100 in order to count the banknotes.

When the banknotes are counted in order to maintain and repair the banknote validator 100, the banknotes are preferably classified into types to be counted. For example, new banknotes, old banknotes, or forged banknotes are continuously counted.

The type of the banknotes to be counted may be designated by the server 300 through the network to be displayed on a display unit (not shown; e.g., of the banknote validator 100). Then, a person near the banknote validator 100 feeds the banknotes of the type designated by the server 300 into the banknote validator 100, and the banknote validator 100 counts the banknotes.

The person may directly set the type of the banknotes to be counted, and may count the banknotes. That is, the person previously sets the type of the banknotes to be counted and feeds the banknotes of the corresponding type into the banknote validator 100. In order for the person to set the type of the banknotes to be counted, a corresponding input menu (not shown) or a corresponding input button (not shown) may be in the banknote validator 100.

As described above, by continuously counting the banknotes by type, the server 300 may group sensing values of the banknotes detected by type by various sensors in the banknote validator 100. For example, ultraviolet ray (UV) reflectance and transmittance values, IR reflectance and transmittance values, magnetic sensor values, visible ray reflectance and transmittance values, tape sensor values, banknote fitness determination reference values, banknote weight and/or density, soil level, and/or banknote images may be grouped by type. As described above, the sensing values are grouped by type, and a distribution range of the sensing values by type may be specified so that the various data items for optimizing the banknote validator 100 may be easily analyzed.

The server 300 may classify the sensing values of the banknotes that are transmitted by the banknote validator 100 through the web adjuster 200 to store the classified sensing values in the banknote DB 400. For example, the sensing values of the new banknotes, the old banknotes, the forged banknotes, and defective banknotes such as torn ones, ones with holes, scribbled or dirty ones, and taped ones are classified by country, denomination or type to be stored. Therefore, the distribution range of the sensing values by type may be grasped and the various data items for optimizing the banknote validator 100 may be easily analyzed.

Therefore, although countries in which the banknote validators 100 are installed vary (that is, a time difference exists between the countries), when the banknote validators 100 are connected to the server 300 through the web adjuster 200 and the banknotes are counted, counting and validating information of the banknotes are classified by type and stored in the banknote DB 400 in real time, so that a manager 500 or other user can access the banknote DB 400 using the web adjuster 200 through the network anytime and anywhere, and search and analyze the various data items and information stored in the banknote DB 400 to feedback the various data items and information without delay or travel to a remote location of the banknote validator(s) 100.

On the other hand, the web adjuster 200 is connected to the banknote validator 100 through the Internet to maintain and repair the banknote validator 100 (that is, to set various sensors, to correct and check banknote images, to receive validation results, to adjust a banknote fitness level, to set an environment, and/or to set parameters in various modes). The expression "web adjuster" is not used to limit the present invention, but rather, defines a unit for executing the above-described function. The web adjuster 200 may be implemented by hardware, software, or a combination thereof. When the banknote validator 100 counts the banknotes, the web adjuster 200 transmits the counting and validating information to the server 300 through the network. When reference information for optimizing the banknote validator 100 (for example, reference information for determining types of various banknotes) stored in the banknote DB 400 is updated, the reference information is automatically transmitted to the banknote validator 100 to optimize the banknote validator 100.

In addition, the web adjuster 200 is connected to a computer (not shown) of the manager 500 or other user through the Internet to display and analyze the various data items and information stored in the banknote DB 400 and to update the reference information for optimizing the banknote validator 100. When the manager 500 modifies the reference information for validation of the banknote validator 100 (that is, the reference information for optimizing the banknote validator 100) using the web adjuster 200, the modified reference information may be directly updated to information for maintaining, repairing and/or optimizing in the banknote DB 400 to be stored.

In addition, the web adjuster 200 may record and manage whether each of the banknote validators is maintained and/or repaired, and may show the maintenance and/or repair result (s) of the corresponding banknote validator 100 and the banknote image, the sensor information, and the banknote validator state information that are stored in the banknote DB 400 to the authorized manager or other user 500. Therefore, the web adjuster 200 is synchronized with the server 300 and the banknote DB 400 in order to perform various operations.

The web adjuster 200 may be provided in an additional web server (not shown), may be built in the smart device (e.g., of the first exemplary embodiment), may be provided in the server 300, or may be provided in a cloud server (not shown) to be operated by the user. Here, the web adjuster 200, the server 300, and the banknote DB 400 are synchronized with each other. Therefore, when information stored in one of the web adjuster 200, the server 300, and the banknote DB 400 is updated, information stored in the other ones is simultaneously updated in real time so that the banknote validator 100 and the manager 500 may check and feedback the information in real time by the web adjuster 200.

Figure 5:
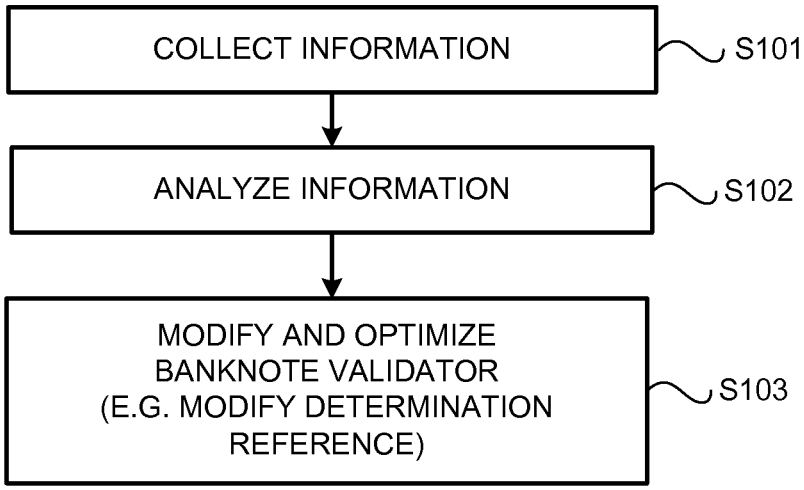
FIG. 5 is a view illustrating an exemplary operation of an apparatus for maintaining, repairing and/or optimizing a banknote validator using a web adjuster over a network according to a second exemplary embodiment of the present invention.

FIG. 5 is a view illustrating an operation of an exemplary apparatus of maintaining, repairing and/or optimizing a banknote validator using a web adjuster over a network according to one or more second exemplary embodiments of the present invention. For convenience sake, earlier description of content common to FIG. 5 and one or more other figures will not be given or repeated.

As illustrated in FIG. 5, the server 300 collects sensing information of the banknotes counted by the banknote validator 100 by type through the web adjuster 200 in S101. Then, the server 300 classifies the collected sensing information by type to store the classified sensing information in the banknote DB 400. That is, the sensing information is grouped by type and stored.

The server 300 analyzes the sensing information grouped by type in S102. For example, since a distribution range of sensing information may be specified in accordance with a type of banknotes, the sensing information may be automatically analyzed. When the distribution range (that is, the boundary) of the sensing information for determining the type of the banknotes is not clear, a reference for determining the boundary may be automatically set by a predetermined algorithm (e.g., in the existing or updated software). When it is difficult to automatically set the reference, a reference for determining the boundary may be manually set by the manager 500.

As described above, when the sensing information for determining the type of the banknotes are automatically or manually analyzed, the banknote validator 100 is optimized based on the analyzed determination reference through the network in S103. Then, the optimization information of the banknote DB 400 is updated or modified based on the analyzed determination reference. When reference information (or optimization information) for optimizing the banknote validator 100 or information for optimizing the banknote DB 400 is updated, the other is automatically updated in real time in synchronization with the updated one. Therefore, the banknote validator 100 is completely maintained and repaired.

The banknote validator 100 may be automatically maintained, repaired and/or optimized by the server 300 when the banknote validator 100 is connected to the Internet. For example, when it is assumed that an arbitrary banknote validator installed in an arbitrary area of a specific country is maintained and/or repaired, an arbitrary banknote validator installed in another area of the specific country may be automatically maintained and/or repaired.

The method of automatically maintaining, repairing and/or optimizing the banknote validator 100 in synchronization of the web adjuster 200, the server 300, and the banknote DB 400 has been described in detail. However, the manager 500 may manually maintain and repair the banknote validator 100 through the web adjuster 200 anytime and anywhere. That is, the banknote validator 100 can be automatically or manually optimized anytime and anywhere.

Figure 6:
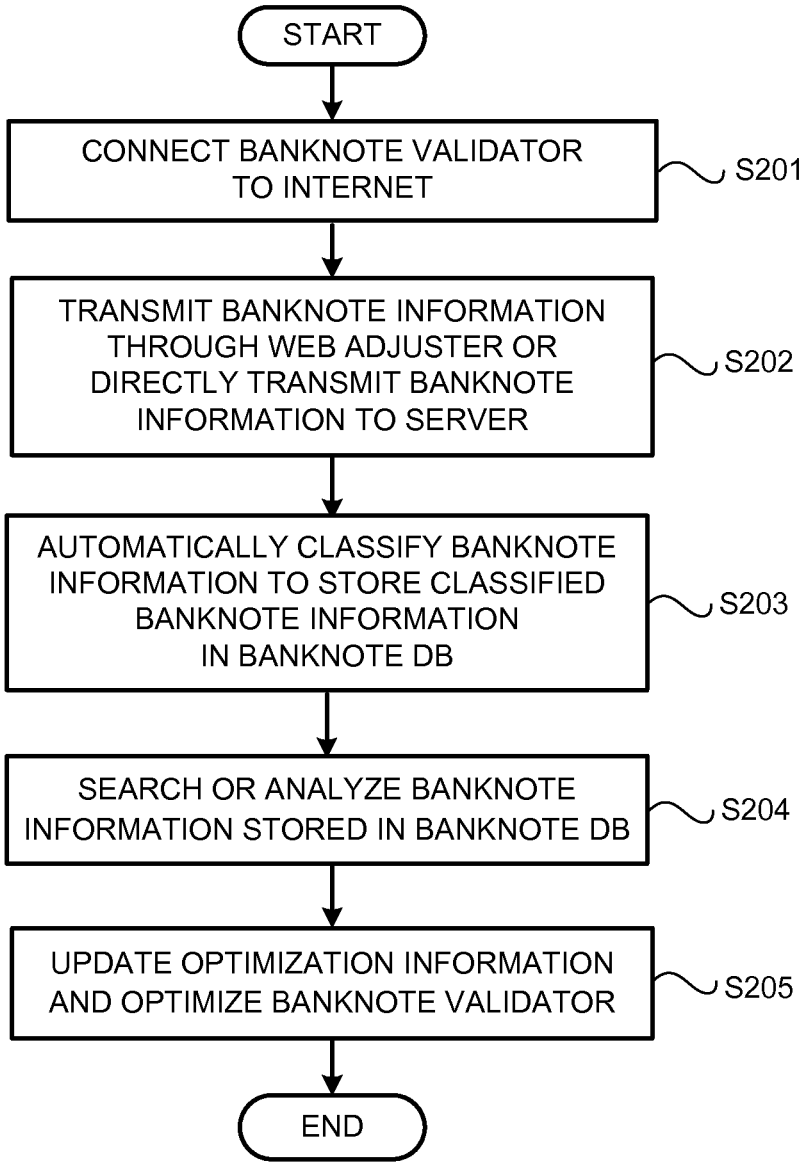
FIG. 6 is a flowchart illustrating an exemplary method of maintaining, repairing and/or optimizing a banknote validator using a web adjuster over a network according to a second exemplary embodiment of the present invention.

FIG. 6 is a flowchart illustrating an exemplary method of maintaining, repairing and/or optimizing a banknote validator using a web adjuster over a network according to one or more second exemplary embodiments of the present invention.

The banknote validator 100 according to the present invention may be directly connected to the Internet by a wired or wireless method. For example, when a LAN line is connected to the banknote validator 100, the banknote validator 100 may be automatically connected to the Internet. When the banknote validator 100 is turned on, a built-in wireless communication module (for example, a Wi-Fi module, a mobile communication module, or a Bluetooth module [not shown]) is turned on so that the banknote validator 100 may be automatically connected to the wireless Internet. That is, the banknote validator 100 is connected to the Internet using one of the above methods at S201.

When the banknote validator 100 is connected to the Internet, the banknote validator 100 is connected to the web adjuster 200 or is automatically connected to the server 300 in accordance with a previously registered IP address. When the banknotes are fed into the banknote validator 100 and counted, internal set information of the banknote validator 100 and the banknote information detected by the banknote validator 100 (for example, the UV reflectance and transmittance values, the IR reflectance and transmittance values, the magnetic sensor values, the visible ray reflectance and transmittance values, the tape sensor values, the banknote fitness determination reference values, the banknote images, counting information including the amount and number of validated banknotes, forged banknote information, sensor operation and state information, banknote weight and/or density, soil level, and/or banknote fitness information) are transmitted to the server 300 through the web adjuster 200 or are directly transmitted from the banknote validator 100 to the server 300 at S202.

Therefore, the server 300 automatically classifies the banknote information (the sensing information by type) and stores the classified banknote information in the banknote DB 400 at S203. That is, banknote information of new denominations of banknotes, new forged banknotes, and new banknote types are automatically classified and stored so that reference information (or optimization information) of sensors configured to validate the banknotes may be updated or modified.

Next, the banknote information stored in the banknote DB 400 is searched or analyzed at S204. That is, the manager 500 may search or analyze the banknote information to manually update the optimization information, and the server 300 may analyze a distribution range of the banknote information by a predetermined algorithm to automatically update the optimization information.

Therefore, when the information stored in the banknote DB 400 is completely analyzed as described above, the optimization information is automatically or manually updated based on the analyzed information, and the banknote validator 100 is maintained, repaired and/or optimized using the updated optimization information at S205. That is, the banknote validator 100 may validate the new denominations of banknotes, the new forged banknotes, and the new banknote types.

The method of remotely maintaining, repairing and/or optimizing the banknote validator 100 through the web adjuster 200 according to the second exemplary embodiment (s) of the present invention has been described. However, a device for executing another function as well as the banknote validator 100 may be maintained, repaired and/or optimized using the above-described configuration and method.

The foregoing embodiments are merely exemplary and are not to be considered as limiting the present invention. It will be apparent to those skilled in the art that modifications and variations can be made without departing from the spirit and scope of the invention. This description is intended to be illustrative, and not to limit the scope of the claims. Also, although an embodiment has not been described in the invention, it should be extensively construed within the scope of the technical concept defined in the claims. And various changes and modifications that fall within the scope of the claims, or equivalents of such scope are intended to be embraced by the appended claims.

What is claimed is:

1. An apparatus for maintaining and/or repairing a banknote validator, the apparatus comprising:

a banknote validator comprising a plurality of sensors configured to count banknotes and determine genuineness and fitness of the banknotes;

a wired or wireless network connection unit comprising a predetermined smart device or web adjuster configured to relay or transmit one or more first data items and software, the first data items and software updating, maintaining and/or repairing the banknote validator and including security information and threshold values of the sensors or parameter values for counting the banknotes and determining the genuineness and the fitness of the banknotes; and a server configured to receive one or more second data items and software version information from the banknote validator, optimize the threshold values of the sensors or the parameter values for counting the banknotes and determining the genuineness and the fitness of the banknotes in the banknote validator, and optionally transmit optimized maintenance and/or repair results to the banknote validator to maintain and/or repair the banknote validator through the wired or wireless network connection unit, wherein the second data items include internal set information of the banknote validator, banknote images, counting data, genuineness determination data, and fitness determination data.

2. The apparatus of claim 1, wherein the second data items further comprise one or more members of the group consisting of UV reflectance values, UV transmittance values, IR reflectance values, IR transmittance values, magnetic sensor values, visible ray reflectance values, visible ray transmittance values, tape sensor values, banknote fitness determination reference values, forged banknote information, sensor operation information, state information, parameter information, log data, serial numbers, sensing history data, state data items of sensors, entire accumulated data, accumulated data since most recently collected data, and software information.

3. The apparatus of claim 1, wherein the first data items and software include the threshold values of the sensors and the parameter values for counting the banknotes and determining the genuineness and the fitness of the banknotes.

4. The apparatus of claim 1, wherein the server is configured to instruct the wired or wireless network connection unit to delete any first data items and software after the first data items and the software are relayed or transmitted to the banknote validator.

5. The apparatus of claim 1, wherein the wired or wireless network connection unit is the predetermined smart device, the predetermined smart device including one or more applications configured to receive and execute commands to update, maintain and/or repair the first data items and the software of the banknote validator.

6. The apparatus of claim 1, wherein the wired or wireless network connection unit is the predetermined smart device, and the predetermined smart device is connected to the banknote validator with hardware or to the server through a predetermined communication path when an application in the predetermined smart device to update, maintain and/or repair the first data items and the software of the banknote validator is executed.

7. The apparatus of claim 1, wherein the wired or wireless network connection unit is the predetermined smart device, and the predetermined smart device is independently connected to the banknote validator to receive the second data items and the software information, to monitor operation states of the banknote validator and states of the sensors, and to adjust or optimize the banknote validator.

8. The apparatus of claim 1, wherein the banknote validator directly accesses the Internet, a designated computer, or at least one previously registered Internet address.

9. The apparatus of claim 1, comprising a plurality of banknote validators, wherein the wired or wireless network connection unit connects the plurality of banknote validators in a predetermined region and simultaneously or sequentially maintains and repairs the plurality of banknote validators and optimizes the banknote validators.

10. The apparatus of claim 1, further comprising a banknote database (DB) configured to classify at least one of the second data items, the software version information, and security information received from the banknote validator by type and storing the classified second data items, the software version information, and/or the security information.

11. The apparatus of claim 10, wherein the banknote validator transmits the second data items to the server through the wired or wireless network connection unit, and updated reference information in the banknote DB is automatically transmitted to the banknote validator through the wired or wireless network connection unit.

12. The apparatus of claim 10, wherein the wired or wireless network connection unit is synchronized with the server and the banknote DB.

13. The apparatus of claim 1, wherein the wired or wireless network connection unit is configured to record and manage whether the banknote validator is maintained and repaired, display and analyze the maintenance and/or repair results, and display and analyze a plurality of data items and/or information in the banknote DB.

14. A method of maintaining, repairing and/or optimizing a banknote validator comprising a plurality of sensors using a network, the method comprising:

connecting a wired or wireless network connection unit comprising a predetermined smart device or web adjuster and a server;

connecting the wired or wireless network connection unit and the banknote validator;

requesting various data items and software version information from the banknote validator using the server, wherein the various data items include internal set information of the banknote validator, banknote images, counting data, genuineness determination data, and fitness determination data;

receiving in the server the various data items;

maintaining and/or repairing the banknote validator by relaying or transmitting one or more additional data items and software through the predetermined smart device or web adjuster, the additional data items and software including security information and threshold values of the sensors or parameter values for counting the banknotes and determining genuineness and fitness of the banknotes;

optimizing the threshold values of the sensors or the parameter values for counting the banknotes and determining the genuineness and the fitness of the banknotes in the banknote validator; and optionally, after maintaining and/or repairing and optimizing the banknote validator, transmitting optimized maintenance and/or repair results to the banknote validator.

15. The method of claim 14, wherein the various data items further comprise one or more members of the group consisting of UV reflectance values, UV transmittance values, IR reflectance values, IR transmittance values, magnetic sensor values, visible ray reflectance values, visible ray transmittance values, tape sensor values, banknote fitness determination reference values, forged banknote information, sensor operation information, state information, parameter information, log data, serial numbers, sensing history data, state data items of sensors, entire accumulated data, accumulated data since most recently collected data, and software information.

16. The method of claim 14, wherein the wired or wireless network connection unit is the predetermined smart device, and the method further comprises receiving the various data items in the predetermined smart device during operation of the banknote validator, monitoring operation states of the banknote validator and states of the sensors using the predetermined smart device, and adjusting or optimizing the banknote validator using the predetermined smart device.

17. The method of claim 14, further comprising causing the banknote validator to directly access the Internet, access a designated computer, or access at least one previously registered Internet address.

18. A method of maintaining, repairing and optimizing a banknote validator comprising a plurality of sensors using a network, the method comprising:

connecting the banknote validator to the Internet;

automatically connecting the banknote validator to a server;

transmitting various data items and software version information of the banknote validator to the server, wherein the various data items include internal set information of the banknote validator, banknote images, counting data, genuineness determination data, and fitness determination data;

classifying the various data items and storing the various data items in a banknote database (DB) using the server;

searching or analyzing the various data items in the banknote DB to update optimization information;

maintaining and/or repairing the banknote validator by relaying or transmitting one or more items of the optimization information and software through a predetermined smart device or web adjuster, the items of the optimization information and software including security information and threshold values of the sensors or parameter values for counting the banknotes and determining genuineness and fitness of the banknotes; and optimizing the threshold values of the sensors or the parameter values for counting the banknotes and determining the genuineness and the fitness of the banknotes in the banknote validator using the updated optimization information.

19. The method of claim 18, wherein the various data items further comprise one or more members of the group consisting of UV reflectance values, UV transmittance values, IR reflectance values, IR transmittance values, magnetic sensor values, visible ray reflectance values, visible ray transmittance values, tape sensor values, banknote fitness determination reference values, forged banknote information, sensor operation information, state information, parameter information, log data, serial numbers, sensing history data, state data items of sensors, entire accumulated data, accumulated data since most recently collected data, and software information.

20. The method of claim 18, further comprising connecting the banknote validator to the server through a wired or wireless network connection unit, wherein the wired or wireless network connection unit comprises the predetermined smart device or the web adjuster.

21. The method of claim 20, wherein the wired or wireless network connection unit is the predetermined smart device, and the method comprises independently connecting the predetermined smart device to the banknote validator and receiving the various data items in the predetermined smart device during operation of the banknote validator, monitoring operation states of the banknote validator and states of sensors using the predetermined smart device, and adjusting or optimizing the banknote validator using the predetermined smart device.

22. The method of claim 18, further comprising causing the banknote validator to directly access the Internet, access a designated computer, or access at least one previously registered Internet address.

* * * * *